US010125964B2

(12) United States Patent
Camarota

(10) Patent No.: US 10,125,964 B2
(45) Date of Patent: Nov. 13, 2018

(54) LINEAR LIGHT CONNECTOR

(71) Applicant: ITC Incorporated, Holland, MI (US)

(72) Inventor: Michael V. Camarota, Holland, MI (US)

(73) Assignee: ITC Incorporated, Hudsonville, MI (US)

( * ) Notice: Subject to any disclaimer, the term of this patent is extended or adjusted under 35 U.S.C. 154(b) by 0 days.

(21) Appl. No.: 14/937,991

(22) Filed: Nov. 11, 2015

(65) Prior Publication Data

US 2017/0130946 A1 May 11, 2017

(51) Int. Cl.

| | |
|---|---|
| ***H01R 33/02*** | (2006.01) |
| ***F21V 23/06*** | (2006.01) |
| ***F21S 4/20*** | (2016.01) |
| ***H01R 13/02*** | (2006.01) |
| *F21Y 101/02* | (2006.01) |

(52) U.S. Cl.

CPC ..... *F21V 23/06* (2013.01); *F21S 4/20* (2016.01); *H01R 13/02* (2013.01); *F21Y 2101/02* (2013.01)

(58) Field of Classification Search

CPC ..... H01R 33/09; H01R 33/7635; H01R 33/0836; H01R 33/02; H01R 33/975; H01R 4/2433; H01R 9/0757; F21Y 2103/00; F21V 15/02

USPC ... 439/56, 58, 226, 232, 239, 242, 366, 375, 439/404, 405; 362/376, 377, 378

See application file for complete search history.

(56) References Cited

U.S. PATENT DOCUMENTS 4,631,377 A * 12/1986 Imazeki ..... H01H 15/025 200/16 F
4,947,082 A * 8/1990 French ..... H01R 33/09 313/318.01
4,990,108 A * 2/1991 Sakaguchi ..... H01R 13/64 439/56
5,064,382 A * 11/1991 Minnis ..... H01R 12/675 439/395
5,121,310 A * 6/1992 Ahroni ..... F21V 21/002 362/238
5,389,010 A * 2/1995 Takano ..... H01R 33/09 439/553
5,556,297 A * 9/1996 Bray ..... H01R 4/2404 439/405
5,722,852 A * 3/1998 Miek ..... H01R 12/616 439/404
5,797,766 A * 8/1998 Tanigawa ..... F21V 19/0025 439/419
5,888,090 A * 3/1999 Achee ..... H01R 25/142 439/417

(Continued)

*Primary Examiner* — Thanh Tam Le

(74) *Attorney, Agent, or Firm* — Varnum, Riddering, Schmidt & Howlett LLP

(57) ABSTRACT

A linear light connector includes a connector base comprising a bottom section, and first and second sidewalls. A first portion of the connector base is configured to receive a first piece of linear light therein. One or more electrical contacts extend along a length of the connector base and include at least one tip extending above a surface of the bottom section within the first portion. The tips may be arranged to align with electrical conductive paths of a piece of linear light positioned in the first portion. A cap may connect to the connector base to apply a downward force to the linear light and engage the linear light with the tips of the contacts.

18 Claims, 7 Drawing Sheets

(56) References Cited

U.S. PATENT DOCUMENTS 6,079,848 A * 6/2000 Ahroni ..... F21V 21/002 362/249.01
6,139,334 A * 10/2000 Forish ..... B60Q 1/2607 362/487
6,343,942 B1 * 2/2002 Okamoto ..... H01R 33/09 439/110
6,583,542 B2 * 6/2003 Nagano ..... H05K 3/301 313/318.01
6,616,475 B2 * 9/2003 Nagai ..... H01R 4/18 439/217
6,619,963 B2 * 9/2003 Nagai ..... H01R 4/2425 439/34
6,692,308 B2 * 2/2004 Henrici ..... H01R 33/97 439/356
6,837,598 B2 * 1/2005 Marcus ..... F21S 8/032 362/235
7,070,443 B2 * 7/2006 Tashiro ..... F21S 48/212 439/404
7,090,529 B1 * 8/2006 Wang ..... H01R 4/2433 439/417
7,114,841 B2 * 10/2006 Aanegola ..... F21V 21/002 362/640
7,156,686 B1 * 1/2007 Sekela ..... H01R 12/675 439/403
7,322,828 B1 * 1/2008 Chiang ..... H01R 13/7175 439/419
7,442,043 B2 * 10/2008 Yuan ..... H01R 12/57 439/135
7,458,705 B2 * 12/2008 Chiba ..... B60Q 1/2696 362/249.01
7,479,044 B1 * 1/2009 MacCrindle ..... H01R 13/426 439/699.2
7,850,341 B2 * 12/2010 Mrakovich ..... G02B 6/001 362/235
7,871,286 B2 * 1/2011 Motohira ..... H01R 13/7175 439/404
7,901,231 B2 * 3/2011 Hwang ..... H01R 4/245 439/235
8,251,710 B2 * 8/2012 Chen ..... H01R 12/7076 439/232
8,491,324 B1 * 7/2013 Yang ..... H01R 33/0836 439/226
8,668,507 B2 * 3/2014 Yang ..... H01R 33/02 439/226
9,306,352 B1 * 4/2016 Lin ..... H01R 4/5066
2008/0137377 A1 * 6/2008 Brengartner ..... F21V 21/002 362/640
2015/0241035 A1 * 8/2015 Dankelmann ..... F21V 21/005 362/219

* cited by examiner

LINEAR LIGHT CONNECTOR

FIELD OF INVENTION

The present invention relates to the field of linear lighting and more specifically to systems, devices, and methods for connecting linear lighting components.

BACKGROUND

Linear and strip lights are used in a variety of applications and industries to provide light along a length or area. Strip lighting commonly consist of a strip or base that may be flexible. The base provides electrical power to a series of lights, arranged in a generally linear configuration. Linear or strip lighting provides many benefits over traditional lighting, including scalability, configurability, and ability to use in a variety of environments. Linear lighting often utilizes LED lighting components, although other lighting components are also used.

In most instances, strip lighting includes a body or outer shell that both protects the internal lighting components, and in some cases provides diffusion properties for the lighting. One example of this type of linear lighting is described in U.S. patent application Ser. No. 14/467,384, which is hereby incorporated in its entirety. The body or outer shell may be made of a flexible material, such as silicon or a polymer, and may be formed by any appropriate method, such as an extrusion process. Processes like extrusion allow the linear lighting to be made in long strips and cut to a desired length. However, other processes such as molding only provide specified lengths of lighting.

Often times linear lighting applications require a break in the lighting or strip, or more than one lighting strip to provide lighting in different directions. In other circumstances, two separate lengths of linear or strip lighting may be needed in order to provide lighting along an entire desired length. In order to power each separate strip of lighting separate power must be run to each strip. However, there are drawbacks to separately powering each strip of lighting.

One primary drawback of separately powering each lighting strip is that it requires excess wiring that is both difficult to install and is unsightly. A cleaner and easier solution is to use power from a first lighting strip to power a second lighting strip, and so on. However, this solution also has difficulties. First, wiring between lighting strips is difficult and may require soldering or other unsightly and difficult wire-connecting methods. Second, any wiring connection between lighting strips often requires a space for the connection, which makes it difficult to have the lighting strips abut one another and create a seamless transition between the first and second lighting strip.

Accordingly, an improved linear lighting connection device and method is need in the industry.

SUMMARY

A linear light connector is generally presented. The linear light connector includes a connector base comprising a bottom section, a first sidewall connected to the bottom portion, and a second sidewall connected to the bottom portion. The connector base includes a first portion configured to receive a first piece of linear light between the first and second sidewalls and on the bottom section. One or more electrical contacts may extend along a length of the connector base. The contacts may include at least one tip extending above a surface of the bottom section within the first portion.

The first portion may be sized and shaped to receive a first piece of linear light therein. The tips may be arranged to be aligned with electrical conductive paths of the piece of linear light when it is positioned in the first portion of the connector base.

The connector may include a second portion configured to receive a second piece of linear light. The contacts may extend to the second portion to electrically connect the second piece of linear light with the first piece of linear light.

The linear light connector may further comprising a cap. The cap may be configured to connect to the connector base. In an embodiment, the cap may include one or more openings configured to latch with one or more protrusions in the connector base. The cap may be sized and shaped to conform to the portion of linear light and, when connected to the connector base, apply a force on the piece of linear light toward the bottom section.

BRIEF DESCRIPTION OF THE DRAWINGS

The operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A linear light connector 10 is generally presented. The connector 10 is configured to receive at least a portion of a first linear light therein and provide an electrical connection to for coupling to a second device, such as a power source, second portion of linear light, or the like. The connector 10 may further be configured to place a first and second portions of linear light into a desired alignment or spacing relative to one another.

Figure 2B:
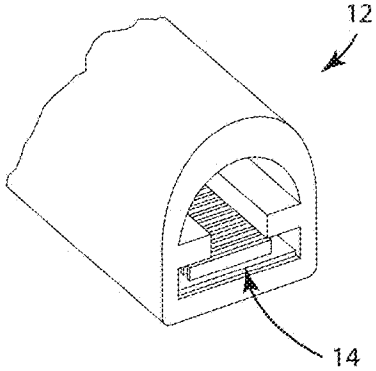
FIG. 2B is a perspective view of a portion of linear light with an open end.
Figure 2A:
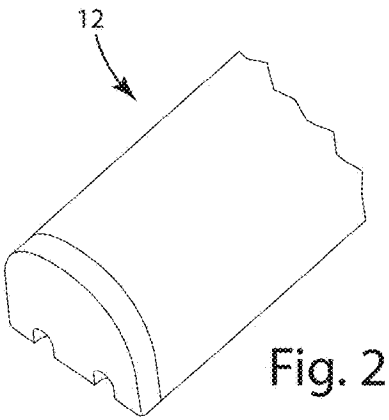
FIG. 2A is a perspective view of a portion of linear light.

As used herein, liner light may mean any type of lighting that is in strip or linear form. An example embodiment of linear light 12 is illustrated in FIG. 2. However, it is to be appreciated that linear light 12, as used herein, is not limited to the embodiment shown, and may include flexible linear light, LED based linear light, diffused linear light, linear tape lighting such as lighting that includes an adhesive, or any other types of linear lighting. The linear light may have any appropriate size, shape, and length. Commonly, the linear light may include a circuit board, such as a printed circuit board ("PCB") 14 that runs along the length of the linear light 12. The PCB 14 may be flexible and any appropriate shape and size, and may be configured to carry power to the lighting elements, such as LEDs, contained within the linear light 12. For example, the PCB 14 may include an first electrical conductive path and a second electrical conductive path, each extending along the length or a portion of the length of the PCB 14. The first and second electrical conductive paths may provide a voltage to the lighting elements to power them.

Figure 1:
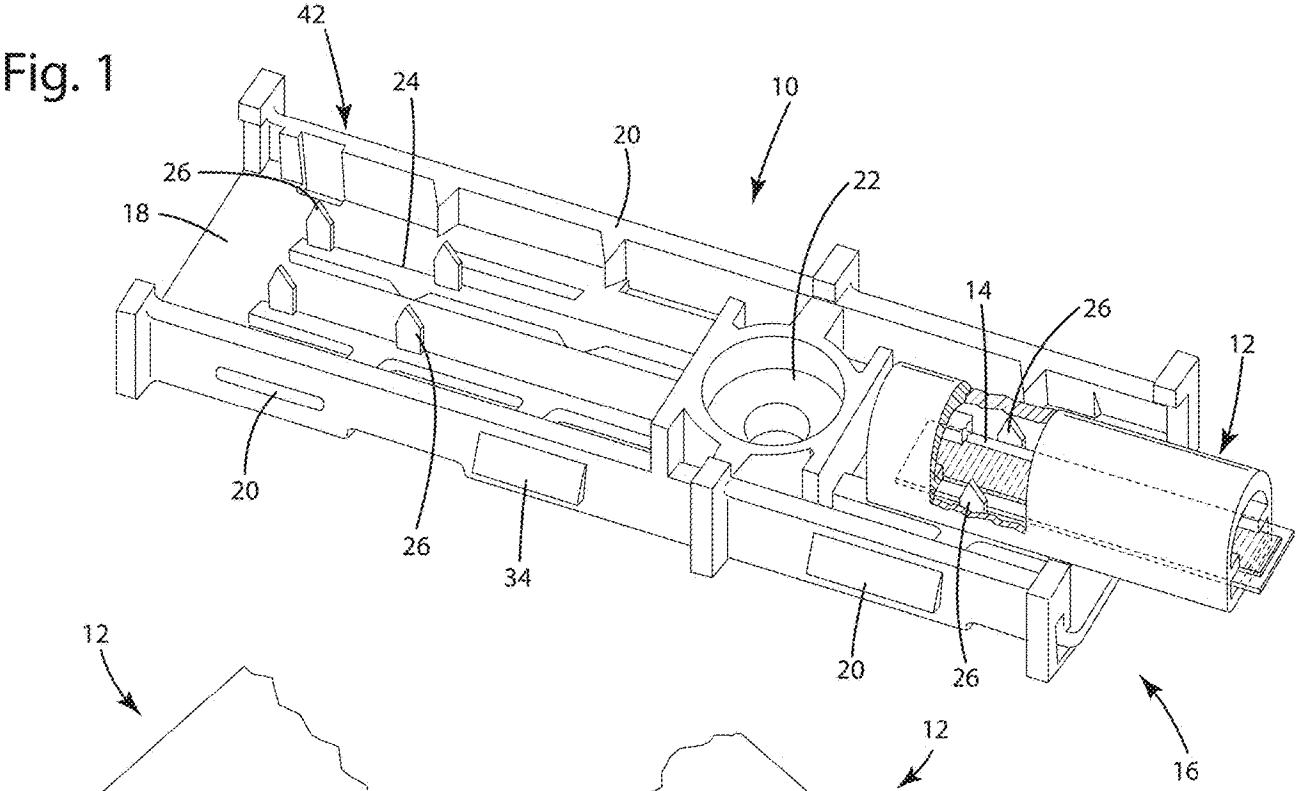
FIG. 1 is a perspective view of a linear light connector base assembly.

The linear light connector 10 may generally comprise a base 16, as illustrated in FIG. 1. The base 16 may be any appropriate size and shape, such as generally rectangular, to receive the bottom of a portion of linear light 12 therein. The base 16 may be made out of any appropriate material, such as plastics or polymers.

The base 16 may include a bottom 18 and two sidewalls 20. The bottom 18 and sidewalls 20 may form a channel to receive a portion of linear light 12 therein. The channel may be sized to create a tension fit for the portion of linear light 12 to help keep the linear light within the connector 10.

In an embodiment, the connector 10 may be connectable to a surface. For example, the connector 10 may include an aperture 22 to receive a fastener, such as a screw or nail, and fix the connector to a surface. The aperture 22 may be any appropriate shape or size, such as generally circular.

Figure 3:
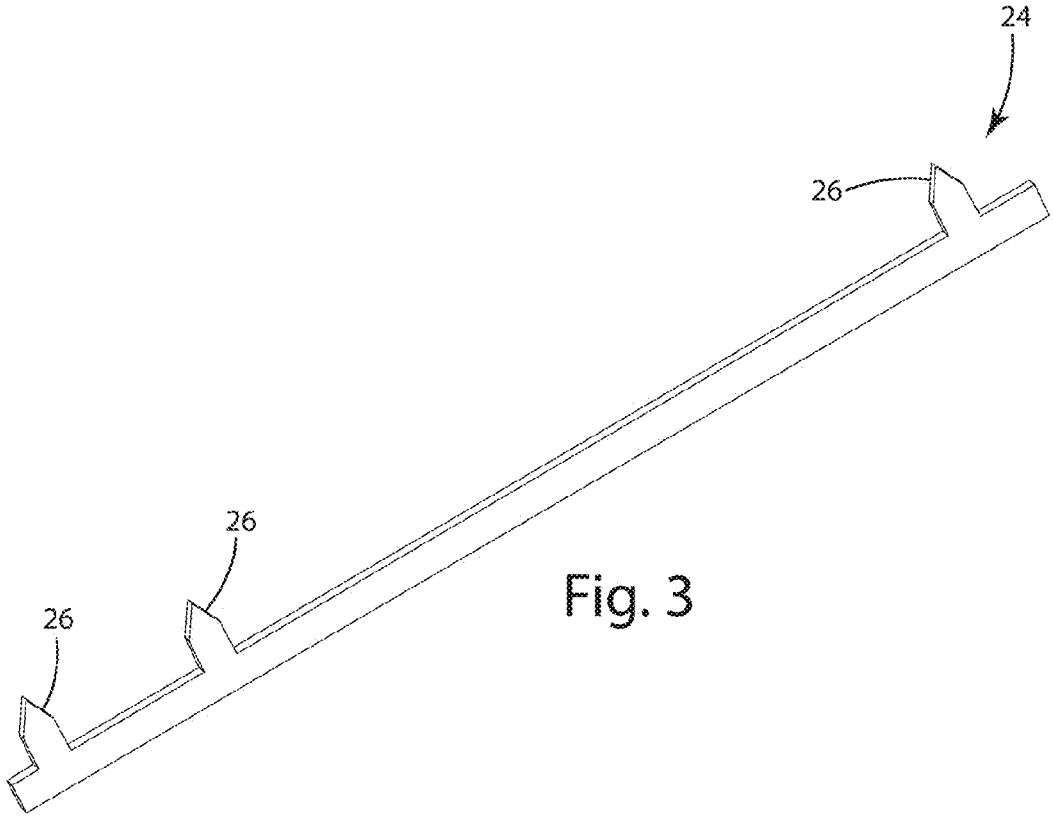
FIG. 3 is a perspective and standalone view of an electrical contact.

The connector base 16 may include one or more contacts 24, as shown in FIG. 3. The contacts 24 may be formed of any appropriate electrically conductive material, such as copper or any metal. The contacts may be connected to, or embedded in, the connector base 16. For example, the contacts may be molded within the plastic or polymer of the bottom 18 of the connector base 16. A portion of the contacts 24 may protrude from the surface of the bottom 18, as described in further detail below.

The contacts 24 may be configured to penetrate an outer surface or jacket of a portion of linear light 12 and contact or connect to an electrical conductive path of the PCB 14. For example, the tip 26 of the contacts may form a pointed edge or prong that protrudes upwardly from the bottom 18 of the connector base 16. The tip 26 may be sharp enough to penetrate an outer surface or jacket, such as a silicon jacket, of a portion of linear light 12.

The one or more contacts 24 may be specifically positioned within the connector base 16 to align with the electrical conductive paths of the PCB 14. For example, in an embodiment, the connector 10 may include two contacts 24. Each contact 24 may be connected to or embedded in the bottom 18 of the connector 10 and may include one or more tips 26. The tips 26 of the first and second contacts 24 may protrude upwardly from the bottom 18 and be positioned to align with a first and second conductive path respectively of a PCB 14 for a specified portion of linear light 12. When the linear light 12 is inserted into the connector 10, the tips 26 may penetrate an outer layer or jacket of the liner light 12 and contact, connect to, or insert into the first and second conductive paths respectively. The contacts 24 may then provide an electrical connection with additional strips of linear light 12 or a power source, as described in further detail below.

Figure 4:
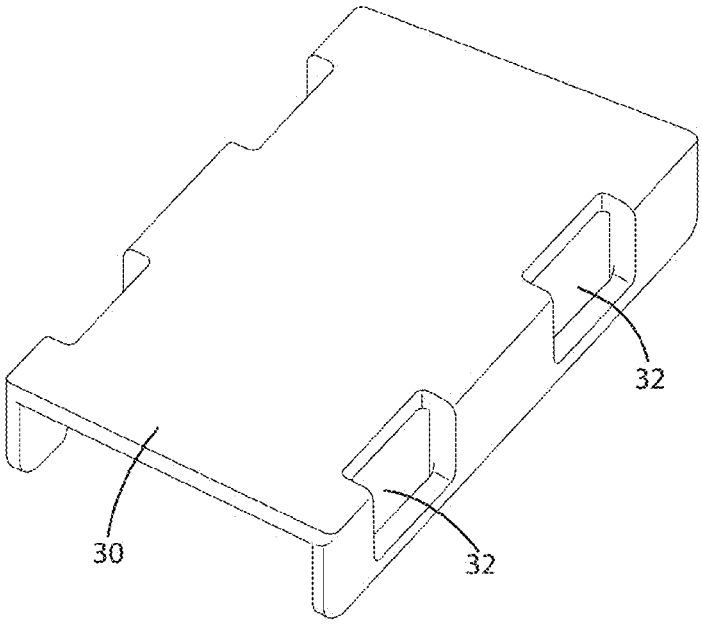
FIG. 4 is a perspective and standalone view of a rectangular linear light connector cap.
Figure 5:
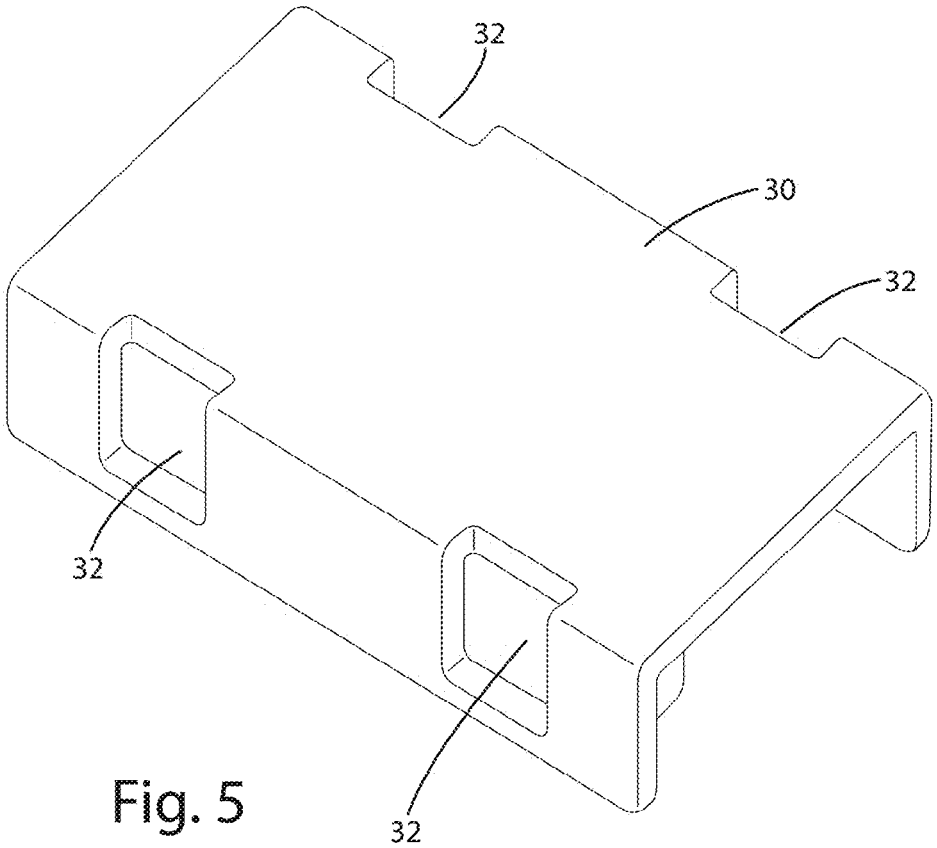
FIG. 5 is a perspective and standalone view of a rectangular linear light connector cap.
Figure 6:
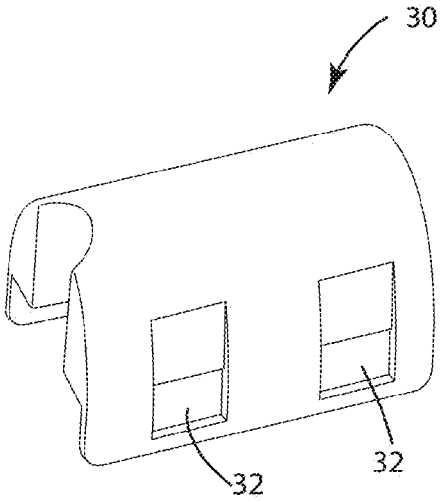
FIG. 6 is a perspective and standalone view of a curved linear light connector cap.
Figure 7:
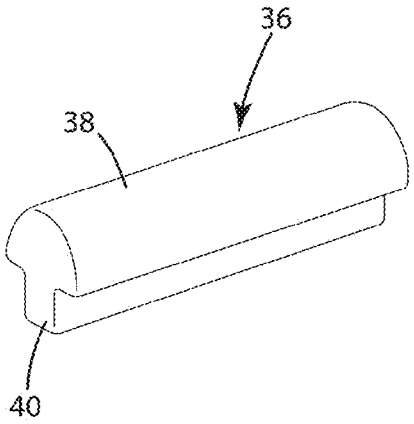
FIG. 7 is a perspective and standalone view of an internal support for preventing cap collapse when pressure would be applied for purposes of piercing the conductor path of the linear light.

The connector 10 may include a cap 30, as illustrated in FIGS. 4-6. The cap 30 may be any appropriate size and shape, such as generally rectangular (as shown in FIGS. 4 and 5) or arcuate (as shown in FIG. 6). The cap 30 may be configured to attach to the connector base 16. For example, the cap may include one or more openings 32 that correspond to a protrusions 34 on the connector base 16 to allow the cap 30 to be latched to the connector base 16. Alternatively, the cap 30 may be hinged, or otherwise connected to the connector base 16.

The cap 30 may be sized and shaped to match the size and geometry of a portion of linear light 12. For example, the portion of linear light 12 positioned within the connector 10 may have a rounded top portion, as illustrated in FIG. 2. Alternatively, the linear light 12 may be generally flat or rectangular shaped. A cap 30 matching the geometry of the linear light may be connected to the connector base 16. When the cap 30 is fully connected to the connector base 16 the underside of the cap 30 may abut the top of the linear light 12 and force it toward the bottom 18 of the connector base 16. The downward pressure from the cap 30 may force the tips 26 through the outer sleeve of the liner light 12 and in contact with the electrical conductive paths of the PCB 14.

As illustrated in in FIG. 6, the cap 30 may have an arcuate or curved top to engage a similarly sized and shaped linear light 12. However, in curved cap 30 may further be adapted for use with a linear light with a thinner or flat profile. For example, an insert 36 may be positioned within the cap. The insert 36 may include an arced section 38 to engage the arced cap, and a keyed section 40 extending downward from the arced section 38 to abut a portion of linear light 12. The insert 36 may allow an arced cap 30 to be used with non-arced linear lights 12.

Various embodiments of connectors 10 will now be described. Each embodiment includes characteristics described above, however each embodiment may contain unique geometries or connection options.

As illustrated in FIG. 1, the connector 10 may have a generally liner configuration to interconnect two portions of liner light 12. The connector may include a first portion 42 on a first side of the aperture 22 and a second portion 44 on the opposing side of the aperture 22. The first and second portions 42, 44 may each be configured to receive a portion of linear light 12 therein. The connector 10 may include two contacts 24 embedded therein. The contacts 24 may each extend from the first portion 42 to the second portion 44. Each contact 24 may include at least one tip 26 protruding upwardly from the bottom 18 in the first portion 42 and at least one tip 26 protruding upwardly from the bottom 18 in the second portion 44. The connector 10 may allow two portions of linear light 12 to be electrically connected together while aligning them in a linear arrangement.

Figure 8:
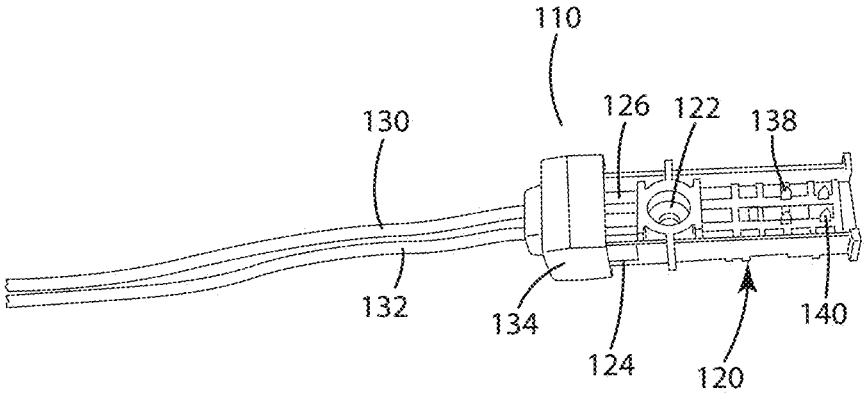
FIG. 8 is a perspective and standalone view of a linear light connector having a wired connection.
Figure 9:
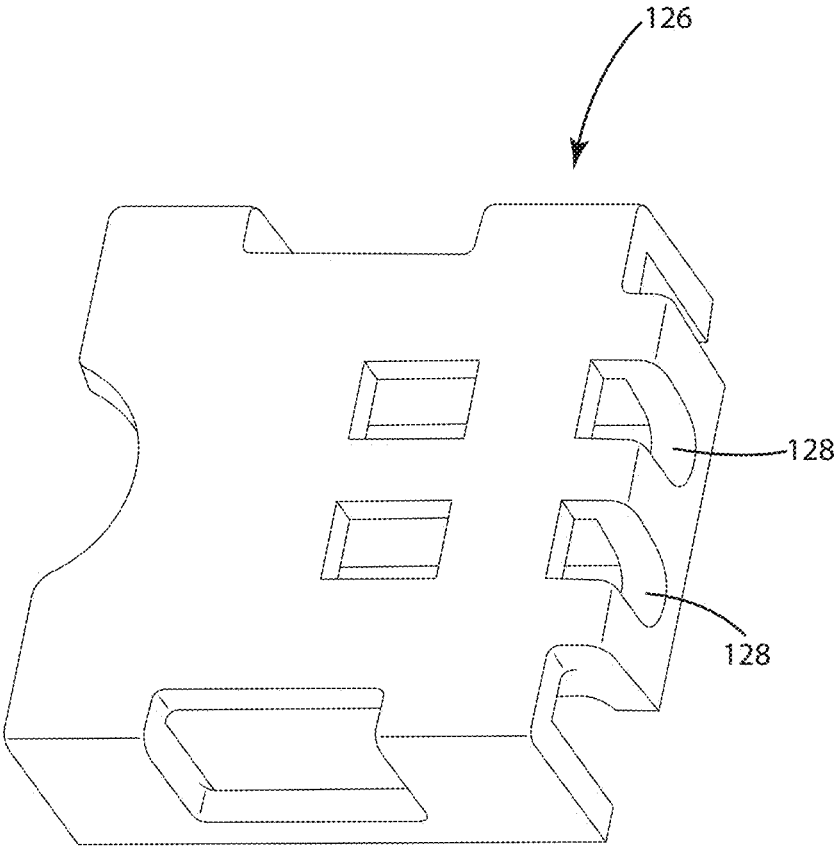
FIG. 9 is a perspective and standalone view of a rectangular linear light connector cap having wire openings.
Figure 10:
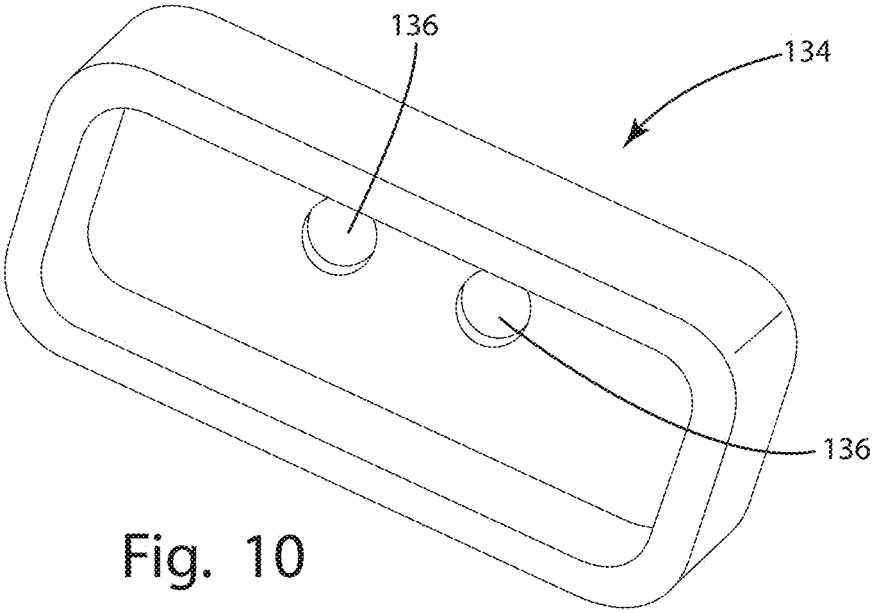
FIG. 10 is a perspective and standalone view of an end cap seal with wire openings.

As shown in FIG. 8, a connector 110 may be configured to interconnect a portion of linear light 12 with a wired connection. For example, the connector may include a first portion 120 on a first side of an aperture 122 and a second portion 124 on a second side of the aperture 122. The wired portion may include a wired cap 126 as illustrated in FIG. 9. The wired cap 126 may include openings 128 to allow wires, such as a first wire 130 and second wire 132, to extend therethrough. An end cap 134 having wire openings 136 may extend over the wire cap 126. The first wire 130 and second wire 132 may connect to a first contact 138 and a second contact 140 respectively, each embedded in the connector 110. The first and second wires 130, 132 may connect back to a power supply, such as the positive and negative leads of a DC power supply. The power may then be fed to a portion of linear light 12 inserted into the connector 110 to power the lighting elements, once the PCB of the linear light is connected to the contacts 138, 140. While the connector 110 is illustrated and described as including a two-wire configuration, it will be appreciated that wired cap 132 may be configured to receive any appropriate number of wires, such as 3, 4, or 5 wires, to connect to the contacts. It will be understood that the connector 110 may include one contact corresponding to each wire connected thereto.

Figure 11:
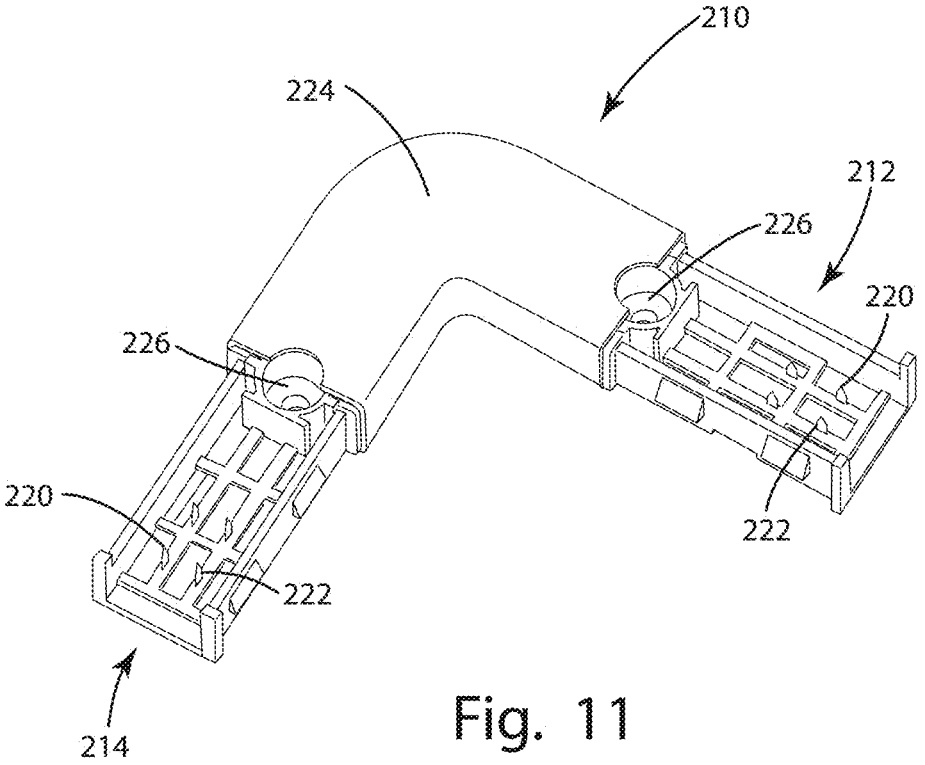
FIG. 11 is a perspective and standalone view of a 90 degree flat corner linear light connector.

In an embodiment illustrated in FIG. 11, a connector 210 may have an L-shaped configuration. The connector 210 may include a first portion 212 and a second portion 214 oriented at a 90 degree angle with respect to each other. A first contact 220 and second contact 222 may each be embedded in the first portion, with tips extending above the surface of the connector 210. The contacts 220, 222 may extend around the 90 degree turn and into the second portion 214, with tips extending above the bottom of the second portion 214. A cover 224 may be placed over the 90 degree portion of the connector 210. The contacts 220, 222 may electrically connect a portion of linear light 12 inserted into the first portion 212 with a portion of linear light 12 inserted into the second portion 214. A cap may be attached to the connector at either or both the first and second portions 212, 214, as described above. An aperture 226 may be located at an end of each portion 212, 214 to allow the connector to be fixed to a surface.

Figure 12:
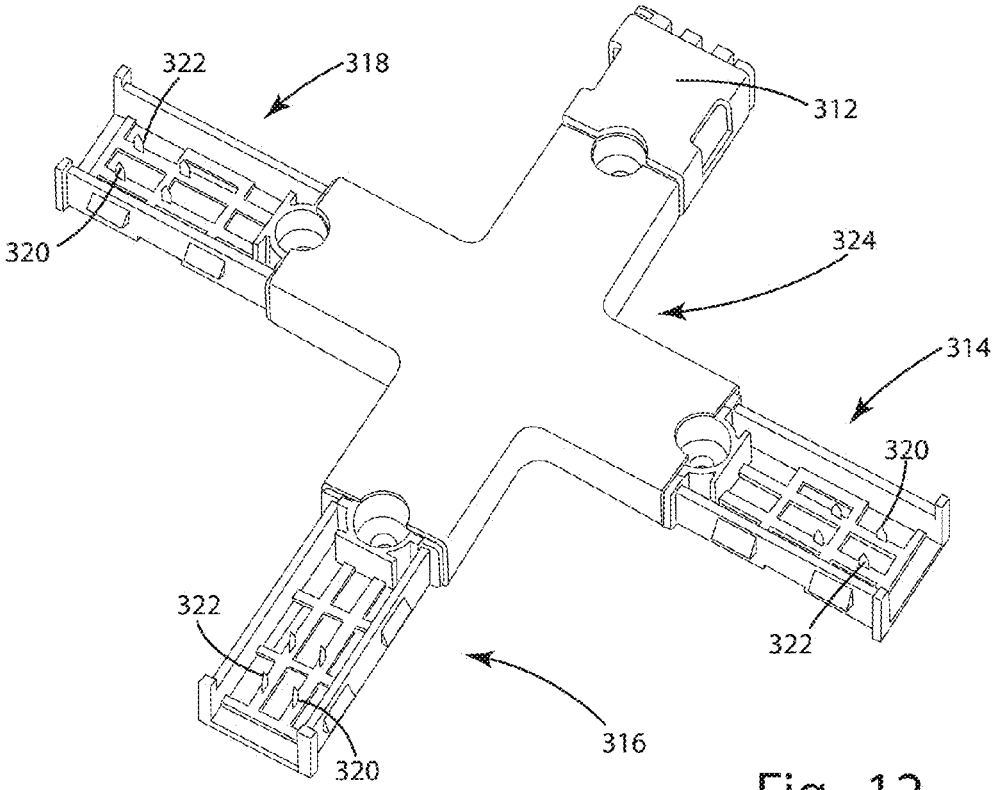
FIG. 12 is a perspective and standalone view of a T-shaped wire to linear light connector junction block.

In an embodiment illustrated in FIG. 12, a connector 310 may have a T-shaped wire-to-three-way junction configuration. The connector 310 may include a first portion 312 having a wired connection, and a second portion 314, third portion 316, and fourth portion 318 each arranged at 90 degree increments with respect to the first portion 312. The second, third, and fourth portions 314, 316, 318 may each include a portion of a connector configured to receive a portion of linear light 12, as described above. A first contact 320 and second contact 322 may each be embedded in each of the second, third, and fourth portions 314, 316, 318, with tips extending above the surface of each portion. The contacts 320, 322 may extend toward a central intersection point of the connector 310, and may interconnect and connect to wires that extend back through the first portion 312. The wires may connect to a power supply to power linear lights 12 inserted into any of the second, third, or fourth portions 314, 316, 318. A cover 324 may be placed over the central t-shaped portion of the connector 310. A cap may be attached to the connector 310 over a portion of linear light 12 at an of the second, third, or fourth portions 314, 316, 318, as described above. An aperture 326 may be located at an end of each portion 314, 316, 318 to allow the connector 310 to be fixed to a surface.

Figure 13:
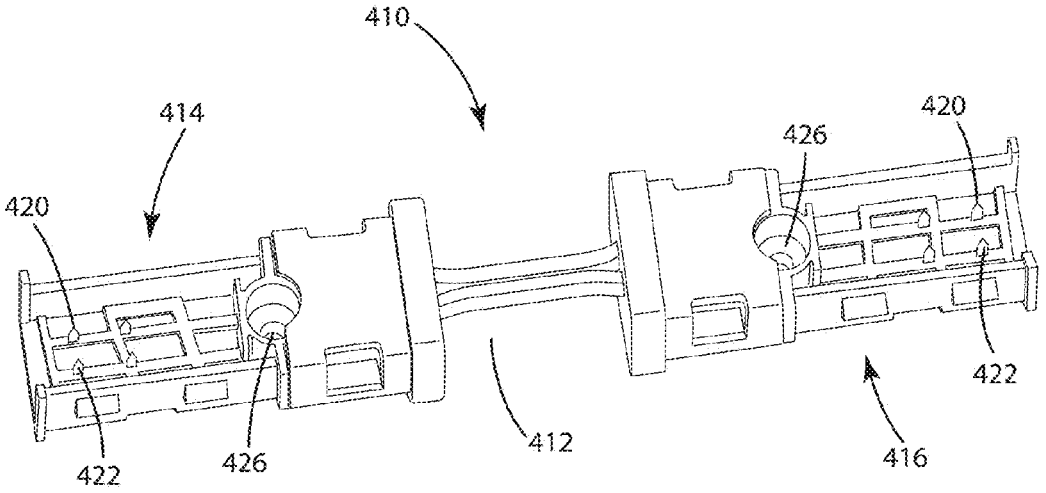
FIG. 13 is a perspective and standalone view of a linear light connector having a one inch spaced opening.
Figure 14:
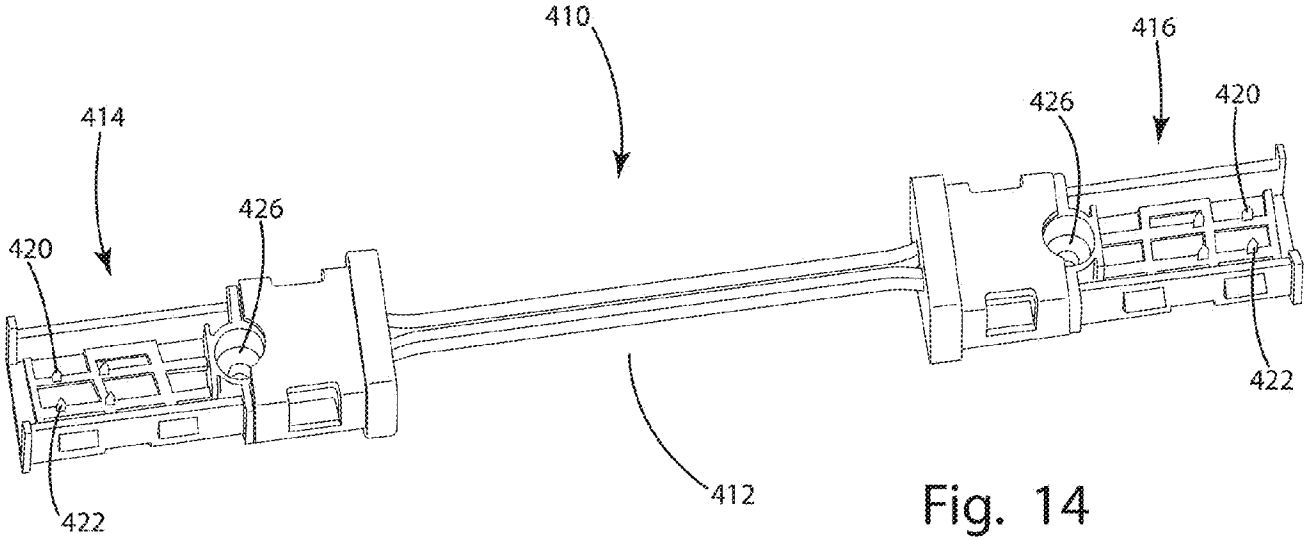
FIG. 14 is a perspective and standalone view of a linear light connector having a three inch spaced opening.

In an embodiment illustrated in FIGS. 13 and 14, a linear light connector 410 may include an opening 412 positioned between a first portion 414 and second portion 416 of the connector 410. The opening 412 may be any appropriate length. For example, the opening may be one inch, as shown in FIG. 13, or may be three inches, as shown in FIG. 14, or may be any other appropriate length. The first and second portions 414, 416 may each be configured to receive a piece of linear light 12 therein, as described above. The linear light pieces 12 may be connected by contacts 420, 422 that extend from the first section 141, through a first wired cap portion 424, through the opening 412, into a second wired cap portion 426, and to the second portion 416. The contacts may each include tips that extend above the surface of the respective portions 414, 416 to engage the electrical conductive paths of the linear light 12, as described above. A cap may be attached to either connector portion 414, 416 over the linear light 12, as described above. An aperture 426 may be located at an end of each portion 414, 416 to allow the connector 410 to be fixed to a surface.

Figure 15:
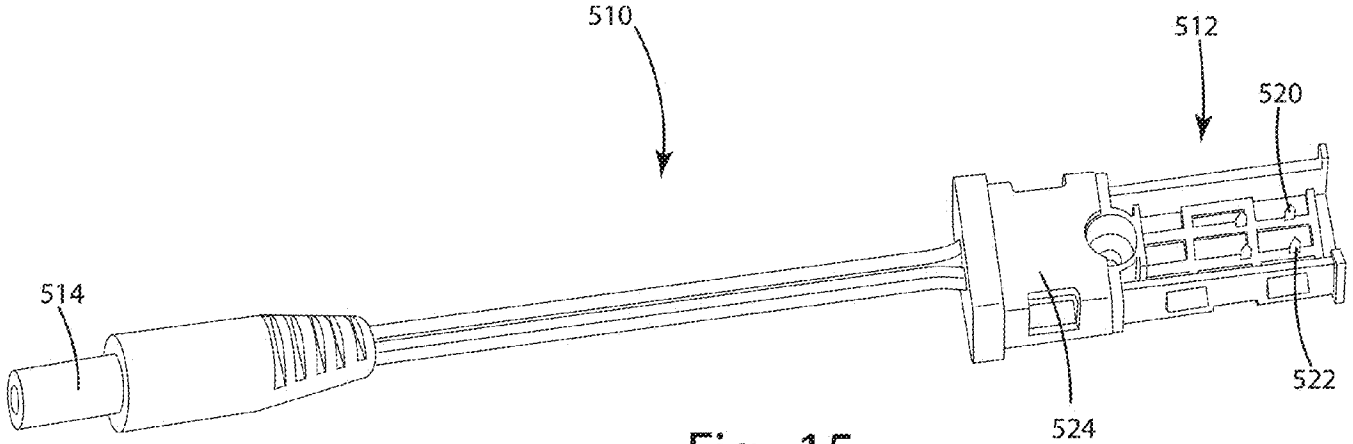
FIG. 15 is a perspective and standalone view of a linear light connector having a connection to a barrel connector.

In an embodiment illustrated in FIG. 15, a connector 510 includes a first portion 512 integrally connected to a barrel connector 514. The first portion may be configured to receive a piece of linear light 12 therein, as described above. A first and second contacts 520, 522 may be embedded in the first portion, with tips extending above the bottom of the first portion 512, and extend through a cap with wire openings 524 to the barrel connector 514. The barrel connector 514 may be configured to engage a counterpart connector to receive power, such as DC power, to power a linear light 12 inserted into the connector 510. A cap may be attached to the first portion 512 over the linear light 12, as described above. An aperture 526 may be located adjacent to the first portion 512 to allow the connector 510 to be fixed to a surface.

While the connector 510 is illustrated in FIG. 15 as interconnecting with a barrel connector 514, it will be appreciated that other components or connectors may be also be integrated into electrical connection with the connector. For example, the connector 510 may be wired directly to a power source. In an embodiment, a component such as a switch (not shown) may be placed in-line with the wired connection to the power source to allow power control to the portion of linear light within the connector. Alternatively, the connector 510 may be wired to any other type of connector component, such as a USB connector (not shown) or any other appropriate type of power or signal connector.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

I claim:

1. A linear light connection assembly comprising:

a connector base including:

a bottom section;

a first and second sidewall each connected to the bottom section; and a first portion of the connector base configured to receive a first piece of linear light therein;

one or more electrical contacts formed of electrically conductive material and extending along an interior length of the connector base, wherein the electrical contacts include at least a tip protruding above a surface of the bottom section within the first portion;

a portion of the linear light positioned within the connector base, the portion of the linear light including an outer jacket surrounding a flexible printed circuit board having one or more conductive paths; and wherein the tip is punctured through a portion of the outer jacket of the linear light and engage the one or more conductive paths of the flexible printed circuit board.

2. The linear light connector of claim 1, further comprising a cap connected to the connector base, wherein the cap is sized and shaped to conform to the portion of linear light and, when connected to the connector base, apply a force to the piece of linear light inserted thereon to engage the one or more conducive paths with the tip.

3. The linear light connector of claim 2, wherein the cap includes an arced cross-sectional shape to engage a similarly shaped arced piece on the linear light.

4. The linear light connector of claim 2 further comprising one or more openings in the cap configured to latch with one or more protrusions in the connector base.

5. The linear light of claim 2 wherein, when connected to the connector base, the cap is sized and shaped to engage the a piece of linear light contained within the first portion and apply a force to the linear light toward the bottom section.

6. The linear light connector of claim 1, wherein the connector base further comprises a second portion configured to receive a second piece of linear light therein.

7. The linear light connector of claim 6, wherein the one or more electrical contacts extend from the first portion of the connector base to the second portion of the connector base.

8. The linear light connector of claim 7 further comprising one or more contact tips extending above the bottom section surface of the second portion.

9. The linear light connector of claim 6, further comprising an aperture in the connector positioned between the first portion and second portion.

10. The linear light connector of claim 1, wherein the one or more contacts are each connected to a wire.

11. The linear light connector of claim 10, wherein the wires are configured to provide power to a piece of linear light engaged with the contacts.

12. A linear light connection assembly comprising:

a connector base including:

a bottom section;

a first and second sidewalls each connected to the bottom section; and a first portion of the connector base configured to receive a first piece of the linear light therein;

one or more electrical contacts formed of electrically conductive material and extending along an interior length of the connector base, wherein the one or more electrical contacts includes at least a tip protruding above a surface of the bottom section within the first portion;

a portion of the linear light positioned within the connector base, the portion of the linear light including an outer jacket surrounding a flexible printed circuit board having one or more conductive paths; and a cap connected to the connector base, wherein the cap is sized and shaped to conform to the portion of linear light when the linear light is connected to the connector base, and the cap is applied a force to the first piece of the linear light when the linear light is inserted thereon to puncture the tip through a portion of the outer jacket and the tip engages the one or more conductive paths of the flexible printed circuit board.

13. The linear light connector of claim 12, wherein the tip is aligned with and configured to engage the one or more conductive paths of the flexible printed circuit board when the linear light is positioned in the first portion of the connector base.

14. The linear light connector of claim 12, wherein the one or more electrical contacts extend from the first portion of the connector base to a second portion of the connector base.

15. The linear light connector of claim 14 further comprising one or more contact tips extending above the bottom section surface of the second portion.

16. The linear light connector of claim 14, further comprising a space between the first portion and the second portion.

17. The linear light connector of claim 16, wherein the contacts extend between the space.

18. The linear light connector of claim 14, further comprising an aperture positioned between the first portion and the second portion.

* * * * *